United States Patent [19]

Besek, Jr.

[11] Patent Number: 4,482,117

[45] Date of Patent: Nov. 13, 1984

[54] FEEDING BOTTLE HOLDER

[76] Inventor: John B. Besek, Jr., 236 D Ave., Coronado, Calif. 92118

[21] Appl. No.: 329,343

[22] Filed: Dec. 10, 1981

[51] Int. Cl.[3] ..... A47D 15/00

[52] U.S. Cl. ..... 248/103; 248/288.3

[58] Field of Search ..... 248/102, 103, 104, 106, 248/279, 288.3, 288.5

[56] References Cited

U.S. PATENT DOCUMENTS

| | | | |
|---|---|---|---|
| 1,178,594 | 4/1916 | Nixon . | |
| 1,590,227 | 6/1926 | Britton . | |
| 1,662,518 | 3/1928 | Jafee et al. . | |
| 1,671,085 | 5/1928 | Nuernberg . | |
| 1,863,163 | 6/1932 | Malti et al. | 248/102 |
| 2,496,478 | 2/1950 | Kinnebrew | 248/103 X |
| 2,673,705 | 3/1954 | Buckley | 248/102 X |
| 3,180,600 | 4/1965 | Kopec . | |

FOREIGN PATENT DOCUMENTS

| | | | |
|---|---|---|---|
| 547660 | 9/1922 | France | 248/103 |
| 914614 | 10/1946 | France | 248/103 |

*Primary Examiner*—J. Franklin Foss

*Attorney, Agent, or Firm*—Baker, Maxham, Callan & Jester

[57] ABSTRACT

A feeding bottle holder for feeding of infants and the like includes a support frame structure having adjustable extensible legs and stabilizing rod for clipping to the frame of a baby buggy, playpen, high chair or stroller and includes an adjustable arm for holding a feeding bottle in a selected position. The support structure is adjustable for various positions on a stroller or buggy and for fitting various sizes and configurations of such carriages.

9 Claims, 3 Drawing Figures

FEEDING BOTTLE HOLDER

BACKGROUND OF THE INVENTION

The present invention relates to holders and pertains particularly to a feeding bottle holder for attachment to a infant's carriage or the like for holding a feeding bottle.

Infants require frequent feeding throughout a day. Such frequent feedings are usually at inconvenient times and locations. For example, infants are frequently transported in strollers or carriages during shopping trips, social visits by the infant's mother, or the like. During such trips it is normally inconvenient to stop and feed the infant when demand arises.

Many attempts to provide feeding bottle holders for attachment to such carriages and the like to permit feeding at will or while under way have been attempted in the past. These holders, however, have certain drawbacks in that they lack the stability and versatility necessary for effectively accomplishing that purpose.

It is accordingly desirable that an improved rugged and versatile feeding bottle holder be available.

SUMMARY AND OBJECTS OF THE INVENTION

It is therefore the primary object of the present invention to provide an improved feeding bottle holder.

In accordance with the primary aspect of the present invention a feeding bottle holder for holding an infant's bottle includes a plurality of adjustable legs for attachment to an infant's carriage with a stabilizing bar, and an adjustable holding arm for the bottle for positioning the bottle in selected positions. The plurality of adjustable legs and arms permit attachment of the holder to various configurations of carriages.

BRIEF DESCRIPTION OF PREFERRED EMBODIMENTS

The above and other objects and advantages of the present invention will become apparent from the following description when read in conjunction with the drawings wherein.

DETAILED DESCRIPTION OF A PREFERRED EMBODIMENT

Figure 1:
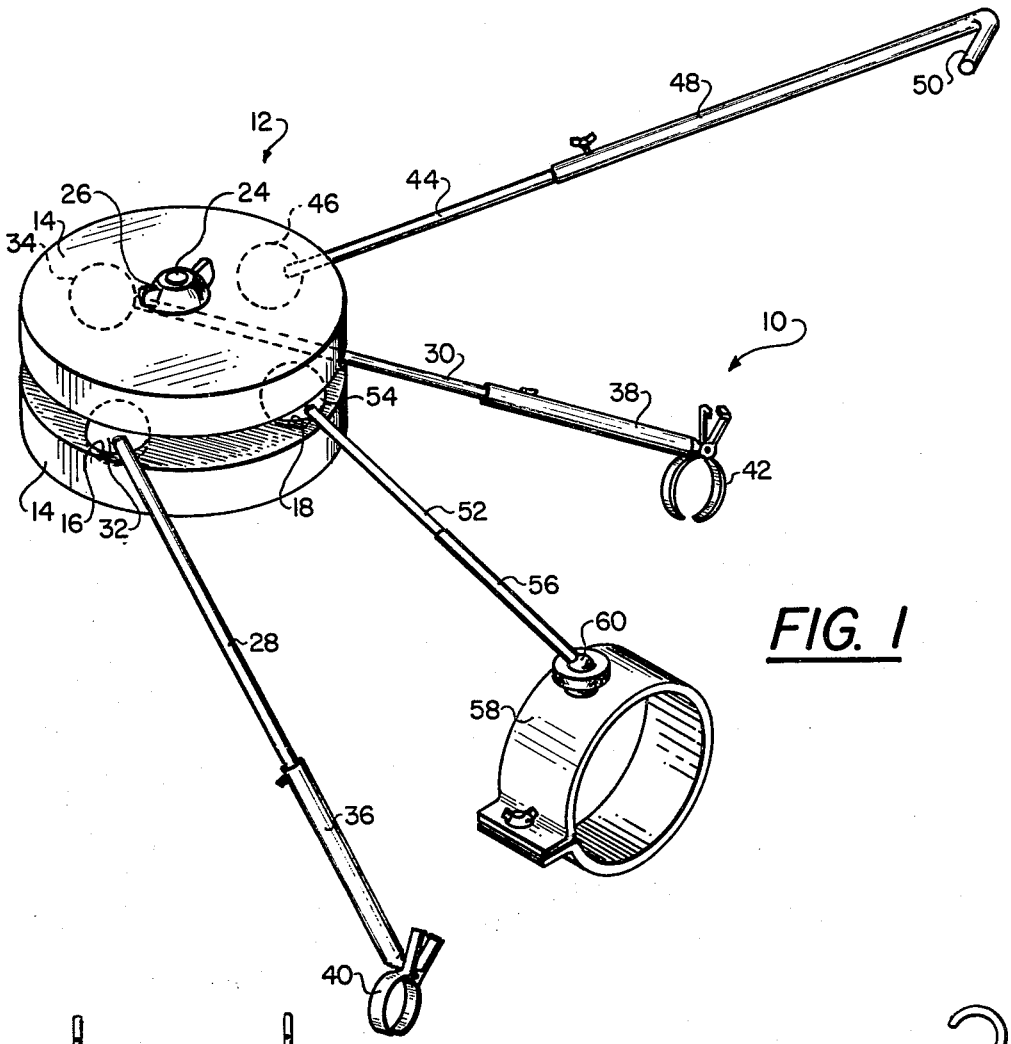
FIG. 1 is a perspective view of a preferred embodiment of the invention.

Turning to the drawings, as illustrated in FIG. 1 the holder assembly designated generally by the numeral 10 comprises a central connector member 12 which includes identical upper clamp block 14 and lower clamp block 14 each of which is formed with a plurality of four (4) semispherical depressions or sockets 16, 18, 20 and 22. Each of the blocks being identical and the spherical depressions positioned to be in direct opposing relationship.

The connecting block or clamp 12 includes means such as a bolt 24 and thumbscrew 26 for adjustably clamping the two members 14 together.

The connecting or clamping member 12 is adapted to receive the spherical ball members that are on the end of the various support and stabilizing rods to be described. More specifically, the holder or support frame includes a pair of legs 28 and 30 each of which respectively includes a ball member 32 and 34 at the upper end thereof and a telescoping tubular portion 36 and 38 on the lower end thereof. These are secured in selected positions on the legs by means of thumb screws as shown. Each of the lower leg members includes spring clips 40 and 42 respectively, which are substantially C-shaped in configuration and are adapted to clip directly to carriage frame members or to other suitable structural portions such as spacer blocks or the like of a carriage or baby's crib or other suitable structure.

The illustrated embodiment is adapted to and is illustrated as being mounted on a conventional stroller of a common construction. In this instance, a stabilizer rod or bar 44, which is telescoping in construction having a spherical joint member 46 at one end received in opposing sockets of the connecting member 12. The opposite end of the telescoping rod 44 includes a tubular portion 48 including a retaining hook or the like 50 adapted to extend into available bores in the framework of the illustrated carriage. Alternatively, a spring or other type clip or clamp could be utilized in place of the retaining hook 50.

A bottle holding arm includes an upper or inner arm 52 having a ball member 54 on one end thereof and telescopingly receiving a tubular member 56 adjustably received thereon and a bottle holder or clamp 58 connected to the outer end of the rod by a suitable frictionally tight swivel joint 60. The bottle holder clamp 58 can be either spring biased into holding engagement with a bottle or be secured by other suitable means such as a screw clamp or the like.

Figure 3:
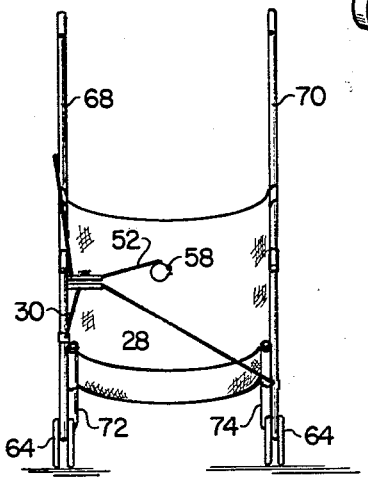
FIG. 3 is a front elevational view of the embodiment of FIG. 2.
Figure 2:
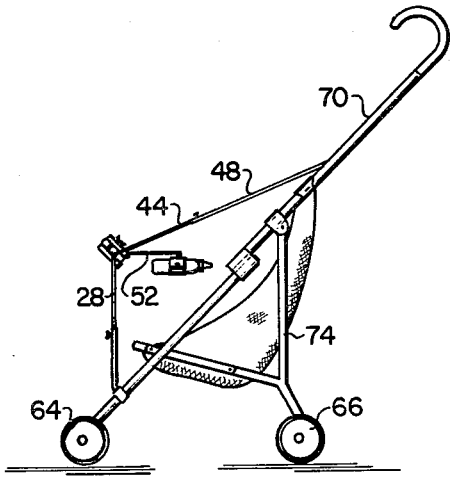
FIG. 2 is a side elevational view of the embodiment of FIG. 1 shown in place on a carriage.

Turning to FIGS. 2 and 3 of the drawings, there is illustrated a baby's stroller or walker of a fairly common construction and configuration, having pairs of front and back ground engaging wheels 64 and 66 respectively mounted on a framework including a pair of upwardly slanting frame or handle members 69 and 70 with cross members (not shown) extending there between. A pair of generally Y-shaped downwardly depending struts 72 and 74 are pivotally secured to the member 68 and 70. A child's seat of canvass or the like 76 is secured between the frame members and adapted to receive and hold a baby or infant.

The feeding bottle holder or support structure is secured to the stroller or carriage by slightly loosening the thumbscrew 26 to permit the leg members 28 and 30 and stabilizing rod 44 to swivel with respect to the connector member 12 and clipping the respective springclips 40 and 42 to the horizontal frame members 68 and 70 or other suitable positions on the structure. After these are clipped in place, a suitable anchoring position is then selected for the stabilizer rod and it is connected into a generally horizontal position on the carriage framework. The connector or pivot block 12 is then positioned in a desired position relative to the center of the carriage by suitable extension and shortening of the respective legs 28 and 30 as will be seen from FIG. 3. When a suitable position is established, the connecting block or clamp is tightened down frictionally gripping the ball members into position holding the support in the desired position. The arm 52 may then be properly adjusted and positioned for holding a bottle 76 in position for the infant to feed. The arm 52 is adjustable to the vertically and horizontally about the ball pivot 54, and is adjustable in length. The clamp 58 is also infinitely adjustable about the ball 60.

The above described holder can be quickly adapted to fit substantially any baby carriage, stroller, or other structure, such as a crib, chair, or other convenient infant holding structure. Moreover, the illustrated and described holder provides for infinite adjustability for positioning in substantially any position relative to a mounting structure. In addition, the bottle can be positioned by means of the bottle holder arm in substantially any position relative to the other support structure.

The clamp block or connector assembly 12 can be adjusted and adapted to provide varying pressures or grip on the various ball members of the structure such that the support structure may be gripped to provide for varying degrees of force to achieve movement of the respective members. Thus, while the framework is securely held in position, the arm 52 may be gripped with sufficiently less pressure to permit positioning an adjustment of the bottle. In addition, the arm can be sufficiently loose to permit the infant to readily grasp the bottle and pull it forward to feed, or to push it to the side, as desired.

While I have illustrated and described my invention by means of specific embodiments, it is to be understood that numerous changes and modifications may be made therein without departing from the spirit and scope of the invention as defined in the appended claims.

I claim:

1. A nursing bottle holder for attachment to a baby carriage or the like, said holder comprising:

a central, adjustable clamp defined by a pair of opposed members having a plurality of spherical sockets formed therein;

a pair of downward depending elongated substantial rigid legs, each adjustably secured at its upper end to said connecting member, and each including clip means at its lower end for attaching to a carriage, and outwardly extending elongated substantially rigid stabilizing rod adjustably secured at one end to said connecting member and including connecting means on the other end for connecting to a carriage, and an elongated substantially rigid bottle holding arm adjustably secured at one end to said connecting member and including a bottle clamp secured to the other end thereof for securing a bottle.

2. The bottle holder of claim 1 wherein said adjustable connecting member is a friction clamp.

3. The bottle holder of claim 2 wherein said legs are each adjustable in length.

4. The bottle holder of claim 3 said bottle holding arm is adjustable in length.

5. The bottle holder of claim 2 wherein the connection of each of said legs, said stabilizing rod, and said bottle holding arm to said connecting member is by means of a ball engaging said sockets.

6. The bottle holder of claim 5 wherein each of said legs are variable in length.

7. The bottle holder of claim 6 wherein said stabilizing rod is variable in length.

8. The bottle holder of claim 7 wherein said holding arm is variable in length.

9. A nursing bottle holder for attachment to a baby carriage or the like, said holder comprising:

a central, adjustable clamp defined by a pair of opposed members having a plurality of spherical sockets formed therewith;

a pair of elongated telescoping substantially rigid downward depending legs each having a ball secured at its upper end to a socket of said clamp and including clip means at its lower end for releasably connecting to a carriage, an elongated substantial rigid outwardly extending stabilizing rod having a ball secured at one end to and disposed in a socket of said clamp and including connecting means on the other end for connecting to a carriage, and an elongated substantially rigid telescoping bottle holding arm secured at one end by a ball to a socket of said clamp and including bottle clamp secured to the other end thereof for releasably securing a bottle therein.

* * * * *